US008627770B2

(12) United States Patent
Severson

(10) Patent No.: US 8,627,770 B2
(45) Date of Patent: Jan. 14, 2014

(54) CARTRIDGE ASSEMBLY HAVING AN INTEGRATED RETENTION SYSTEM

(75) Inventor: Gregg J. Severson, Credit River Township, MN (US)

(73) Assignee: BAE Systems Land & Armaments, L.P., Santa Clara, CA (US)

( * ) Notice: Subject to any disclaimer, the term of this patent is extended or adjusted under 35 U.S.C. 154(b) by 102 days.

(21) Appl. No.: 13/155,014

(22) Filed: Jun. 7, 2011

(65) Prior Publication Data

US 2012/0204751 A1 Aug. 16, 2012

Related U.S. Application Data

(60) Provisional application No. 61/353,914, filed on Jun. 11, 2010.

(51) Int. Cl.
*F42B 33/02* (2006.01)
*F42B 5/26* (2006.01)

(52) U.S. Cl.
USPC ..... 102/464; 102/430; 102/439; 102/462; 102/282; 86/25; 86/29; 86/31

(58) Field of Classification Search
USPC ..... 102/430, 431, 443, 464, 439, 462, 463, 102/282; 86/23, 25, 29, 31
See application file for complete search history.

(56) References Cited

U.S. PATENT DOCUMENTS

| | | | | |
|---|---|---|---|---|
| 441,904 | A * | 12/1890 | Seabury | 102/464 |
| 2,373,883 | A * | 4/1945 | Ferrel | 102/499 |
| 4,449,458 | A * | 5/1984 | Buckley et al. | 102/430 |
| 4,461,214 | A * | 7/1984 | Black | 102/440 |
| 5,031,541 | A * | 7/1991 | Gardner et al. | 102/443 |
| 5,062,343 | A * | 11/1991 | Sjoberg | 86/20.1 |
| 5,090,323 | A * | 2/1992 | Kallevig et al. | 102/282 |
| 6,152,039 | A | 11/2000 | Lee et al. | |
| 6,526,892 | B2 | 3/2003 | Heitmann et al. | |
| 7,370,585 | B2 * | 5/2008 | White et al. | 102/282 |
| 2011/0030571 | A1 | 2/2011 | Lee | |
| 2011/0290143 | A1 * | 12/2011 | Heitmann et al. | 102/466 |

FOREIGN PATENT DOCUMENTS

| | | | |
|---|---|---|---|
| JP | 3146005 | B2 | 3/2001 |
| KR | 10-0843573 | B1 | 7/2008 |
| WO | WO 2005-095884 | A1 | 10/2005 |

OTHER PUBLICATIONS

International Search Report and Written Opinion from PCT/US2011/039468, filed Jun. 7, 2011 (mailed May 1, 2012), 10 pgs.

* cited by examiner

*Primary Examiner* — James Bergin
(74) *Attorney, Agent, or Firm* — Patterson Thuente Pedersen, P.A.

(57) ABSTRACT

A cartridge assembly for large bore gun systems having an integrated retention assembly for maintaining propellant charges within the cartridge case. The cartridge case having an interior space for receiving propellant charges and an open proximate end through which the propellant charges can be fed. An insulating sleeve defining an interior channel is affixed to the cartridge case and extends out of the proximate end of the cartridge case. The interior channel serves as a chute through which propellant charges can be fed. After the propellant charges are loaded, the insulating sleeve is crimped closed to retain the propellant charges within the cartridge case. A closure plug can be inserted into the proximate end of the cartridge case after the insulating sleeve is crimped closed.

14 Claims, 9 Drawing Sheets

CARTRIDGE ASSEMBLY HAVING AN INTEGRATED RETENTION SYSTEM

RELATED APPLICATIONS

This application claims the benefit of U.S. Provisional Patent Application 61/353,914 filed Jun. 11, 2010 entitled "Cartridge Assembly Having an Integrated Retention System." the entire contents of which are hereby incorporated by reference.

GOVERNMENT LICENSE RIGHTS

This invention was made with Government support under U.S. Government Contract N00024-05-C-5117, awarded by The Naval Sea Systems Command. The government has certain rights in the invention.

FIELD OF THE INVENTION

The present invention is generally directed to an apparatus and related methods for retaining propellant charges within cartridge cases during loading and firing of gun systems. More specifically, the present invention is directed to a cartridge assembly having an integrated retention system for retaining propellant charges within cartridge cases for use in gun systems having automated loading systems.

BACKGROUND

Large land based artillery and naval gun systems often employ a multi-step loading process in which the projectile and the propellant charge are separately loaded into the firing chamber and subsequently mated together within the firing chamber. Separately loading the propellant charges allows operators of a gun system to adjust the amount of propellant loaded depending on the intended travel distance of the projectile and other firing conditions. Propellant charges can be loaded as a single charge or as a plurality of smaller charges depending on the firing requirements. While separately loading the propellant charges significantly increases the flexibility of long ranged gun systems, the introduction of automated reloading systems and new strategies for using gun systems have created new problems not previously encountered that may interfere or conflict with the traditional multi-step loading process.

In many gun systems, the propellant charges are first loosely loaded into a cartridge case before the entire cartridge assembly is loaded into the firing chamber and mated to the projectile. The cartridge case may include an integrated primer for igniting the propellant charges. Wadding or a plug is often placed over the opening of the cartridge case to ensure that the maximum force of the generated gases from the ignited propellant charges is directed against the projectile. The wadding or plug assists in sealing the expanding propellant gases behind the projectile. While preloading the propellant charges into a cartridge case simplifies the reloading process by allowing operators or automated reloading machinery to handle a single cartridge assembly instead of a plurality of small charges, maintaining the propellant charges within the cartridge case during loading is often difficult.

During loading, a cartridge assembly is chambered by either a manual or a powered ramrod to ram the cartridge assembly into the firing chamber and against the projectile. As the propellant charges for large gun systems can often weigh dozens of pounds, the inertia of the moving propellant charges can cause the propellant charges to continue moving forward even after the rim of the cartridge case is abutted to the base of the projectile. The forward motion of the propellant charges can cause the cartridge cap or wadding to be displaced or the propellant charges to escape the cartridge case.

Propellant charges can be preloaded into a combustible bag before the charges are placed in the cartridge case to help keep the propellant charges together during loading and firing. However, this approach adds an additional step to the reloading process, potentially increasing the reloading time of the gun system. Furthermore, fitting the combustible bag over the propellant charges and within the cartridge case without blocking the interface between the projectile and the cartridge case can be difficult. The presence of a primer in the cartridge case can also interfere with the use of the bag. As such, there is still room for improvement in within cartridge cases.

SUMMARY OF THE INVENTION

The present invention is directed to a cartridge assembly for large bore gun systems such as artillery pieces and naval guns. The invention includes an integrated retention assembly for maintaining propellant charges within the cartridge case. A cartridge case generally includes an elongated body defining an interior space for receiving a propellant charge and having an open proximate end through which the propellant charge can be fed. The proximate end is located closest to the projectile when the cartridge case is chambered in the gun.

The advent of automated reloading systems has significantly shortened reloading times in gun systems. However, the rapid reloading capabilities provided by automated reloading systems have also created significant safety risks. An automated reloading system allows a single gun system to fire multiple projectiles in rapid succession, often before the firing chamber has an opportunity to cool from the previously fired rounds. As propellant charges are combustibles that can ignite when exposed to high temperatures, the propellant charges can prematurely ignite if the cartridge cap is displaced, exposing the propellant charges inside the cartridge case to high temperatures or if the propellant charges escape the cartridge case and come into contact with the hot interior walls of the firing chamber.

Sometimes guns misfire. In a misfire the propellant charge does not properly ignite. Removing misfired or unfired propellant charges from the firing chamber can also create a risk of unintended ignition, if the propellant charges spill from the cartridge case as the misfired cartridge case is extracted from the firing chamber and contact hot surfaces within the firing chamber if the gun has been previously fired.

According to an embodiment of the invention, an insulating sleeve defining an interior channel is affixed to the cartridge case and extends out of the open proximate end of the cartridge case prior to loading of the propellant. The interior channel serves as a chute through which propellant charges can be inserted into the cartridge case. After the propellant charges are loaded, the insulating sleeve is gathered or folded and crimped closed to retain the propellant charges within the cartridge case.

In an example embodiment, the insulating sleeve is formed from a high tensile strength, insulating material that secures the propellant charge and inhibits the propellant charge from moving toward the proximate end of the cartridge case during loading of a cartridge or extraction of a misfired cartridge case. The insulating sleeve also insulates the propellant charges from hot gases and surfaces within the firing chamber when the cartridge case is loaded into a hot firing chamber.

According to an embodiment of the invention, a high tensile strength strap can be used to secure and crimp the insulating sleeve closed at its proximate end. In another aspect of the invention, an adhesive strip can be affixed to the insulating sleeve to reinforce the high tensile strength strap to assist in securing the insulating sleeve against opening during loading of the cartridge or extraction of a misfired cartridge. High strength and temperature resistant adhesive or adhesive tape is used to affix the insulating sleeve to the cartridge case and help keep the insulating sleeve closed.

According to an embodiment of the invention, a closure plug can be inserted into the proximate end of the cartridge case to assist in efficient use of the gases generated by the ignited propellant charges. According to an embodiment of the invention, the closure plug can include a distal conical indent or other space defined for receiving the crimped portion of the interior bag so that the closure plug evenly sits in the proximate end of the cartridge case. The closure plug can also have a proximate conical indent or other shaped indentation for interfacing with certain irregularly shaped projectiles.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be understood in consideration of the following detailed description of various embodiments of the invention in connection with the accompanying drawings, in which.

Figure 1:
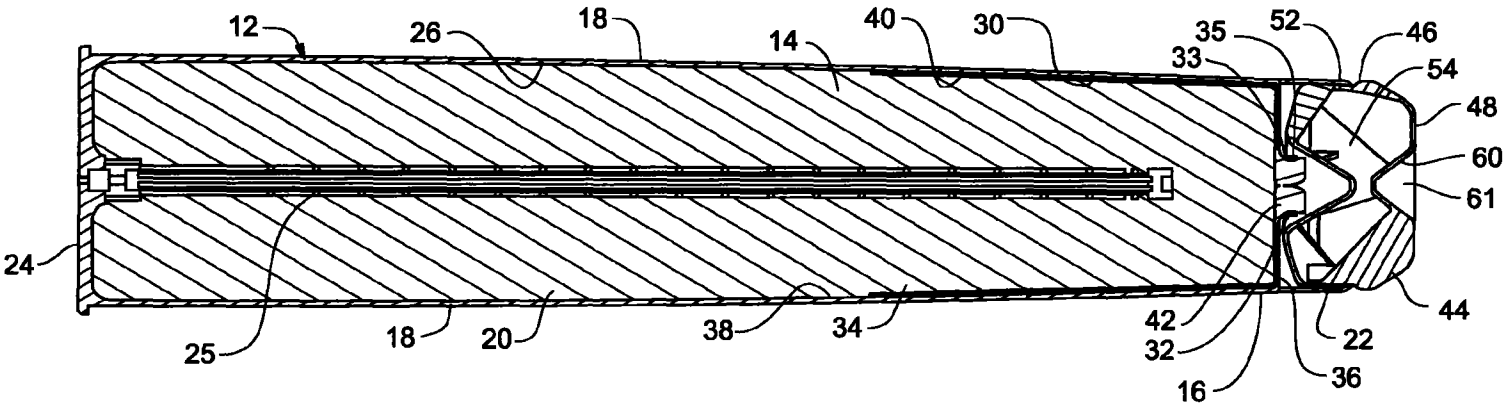
FIG. 1 is a longitudinal sectional view of a cartridge assembly according to an embodiment of the invention.
Figure 2:
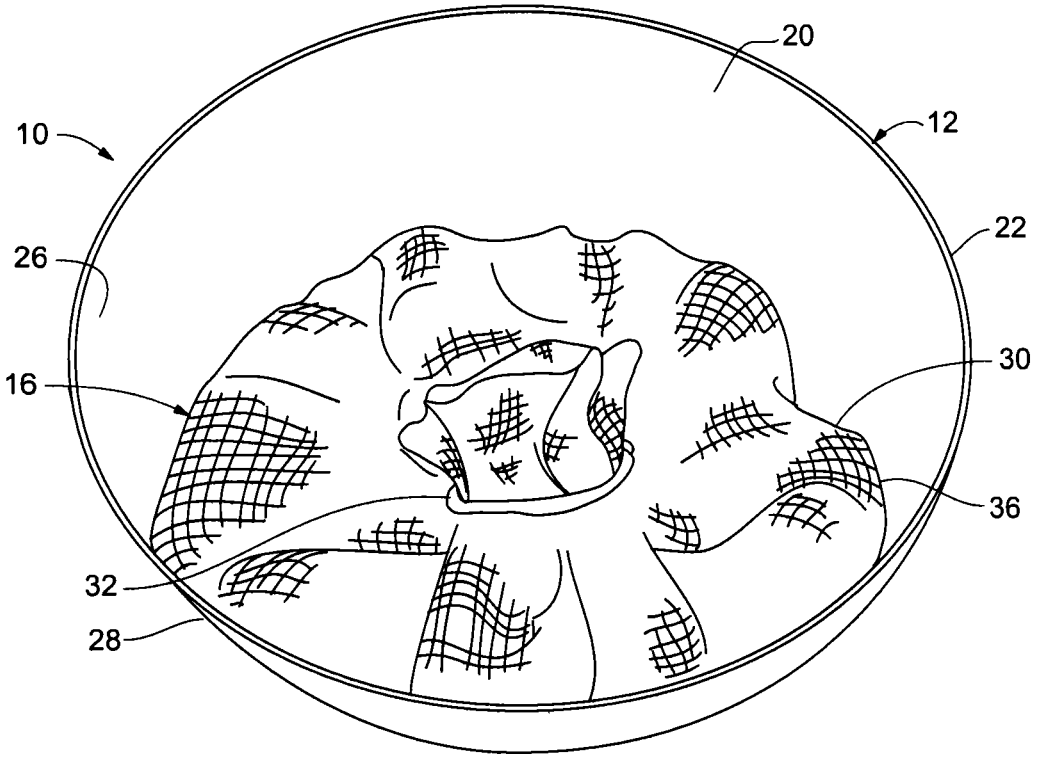
FIG. 2 is a perspective view into a proximate opening of the cartridge assembly depicting an insulated retention bag according to an embodiment of the invention.
Figure 3:
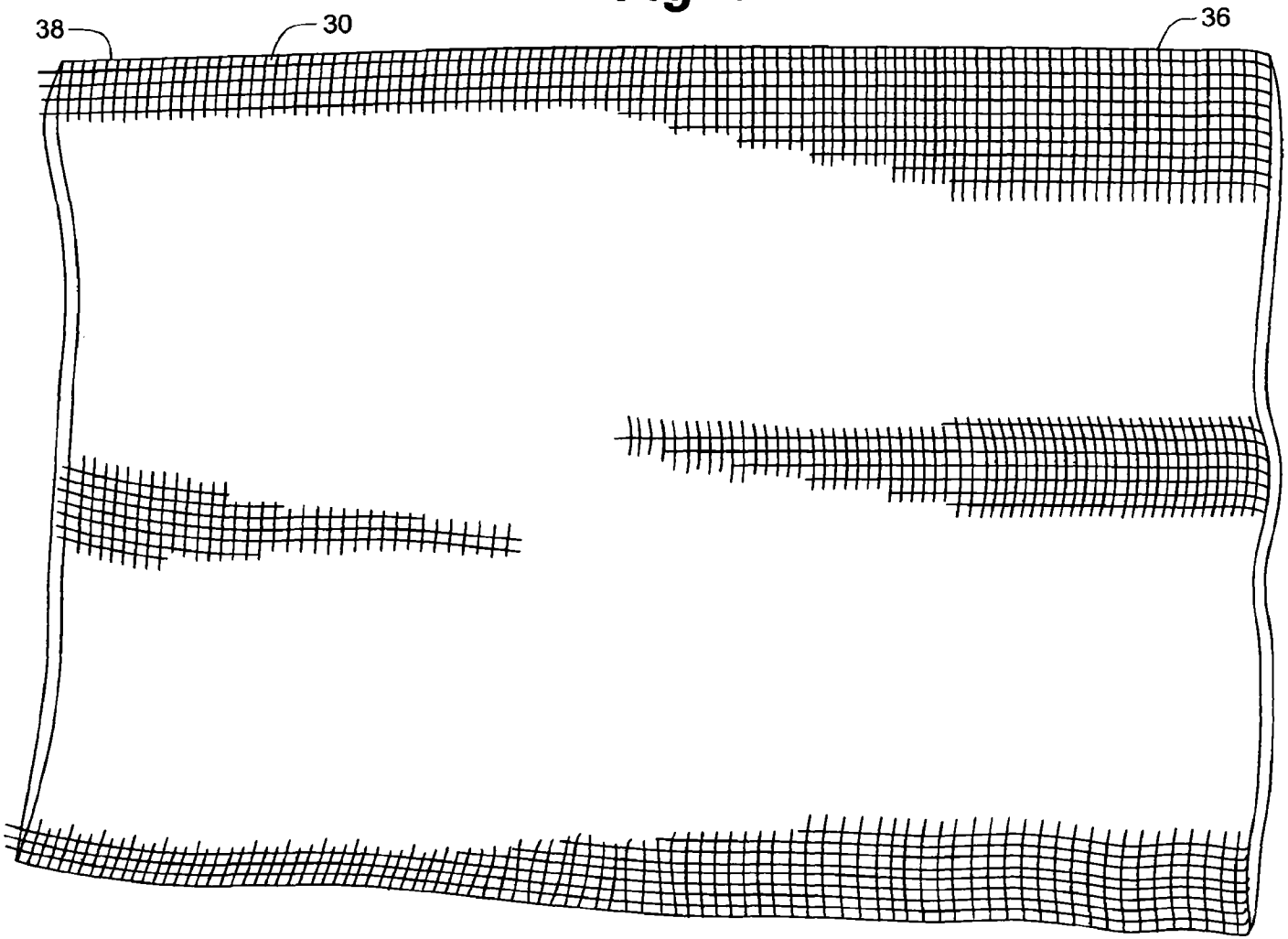
FIG. 3 is a perspective view of an insulated retention bag according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE FIGURES

As depicted in FIG. 1, cartridge assembly 10 according to an example embodiment of the invention includes cartridge case 12, at least one propellant charge 14, and retaining assembly 16. The cartridge case 12 comprises generally cylindrical elongated body 18 defining interior space 20 for receiving propellant charge 14 and having open proximate end 22 and closed distal end 24. Cylindrical for the purposes of this application includes tapered cartridge cases 12. Cartridge case 12 is generally formed of metal, such as, for example, brass. Elongated body 18 further presents interior surface 26 and exterior surface 28. According to an embodiment of the invention, cartridge case 12 further includes commonly includes primer 25 extending through the distal end 24 of the cartridge case 12 and projecting into interior space 20.

Propellant charge 14 can be formed as a single unitary propellant charge as depicted in FIG. 1 or be made up of a plurality of individual propellant charge units packed within cartridge case 12. Propellant charge 14 can be solid or granular. According to one embodiment of the invention, the total weight of propellant charge 14 does not exceed about 28.5 kg. This should not be considered limiting.

Retaining assembly 16 includes insulating sleeve 30 and closure member 32. Insulating sleeve 30 has a generally cylindrical shape surrounding and defining interior channel 34 and having open proximate end 36 and open distal end 38. Flexible insulating sleeve 30 may be formed from insulating Kevlar mesh, wool/rayon blend or any other insulating material having sufficient tensile strength to retain the propellant charge 14 under the acceleration expected during loading, ramming and handling of cartridge assembly 10. In an example embodiment, insulating sleeve 30 is formed from 0.030" Kevlar netting.

In one example embodiment, insulating sleeve 30 further includes adhesive strip 40 disposed on the exterior of insulating sleeve 30 near the distal end thereof. Other forms of adhesive may be used as well, such as hot melt adhesives. Or, adhesives may be applied to or integrated into insulating sleeve 30. Adhesive strip 40, according to one embodiment of the invention, can include an adhesive tape such as, but not limited to, the 3M-1099 and 3M-DP-460 tape products produced by the 3M Corporation of St. Paul, Minn.

Closure member 32 is adapted to crimp closed proximate end 36 of insulating sleeve 30 and retain propellant charge 14 within cartridge case 12. Closure member 32 may include first tie 33 made of, for example, Kevlar parachute cord, a nylon tie, or any other closing means having sufficient tensile strength to secure closed proximate end 36 of insulating sleeve 30 from reopening during loading, handling and extraction of cartridge assembly 10. In an example embodiment, closure member 32 can further include second tie 35 to further reinforce first tie 33. According to another embodiment of the invention, second adhesive strip 42 is disposed on the interior of insulating sleeve 30 at proximate end 36. Adhesive strip 42 may form a part of closure member 32 securing proximate end 36 of the insulating sleeve 30 from reopening or may be used alone to secure proximate end 36 of the insulating sleeve 30 from reopening.

As shown in FIGS. 1 and 4-8, the cartridge assembly 10 can further include closure plug 44 insertable into proximate end of cartridge case 12. Closure plug 44 assists in inhibiting the leakage of gases generated by the ignited propellant charge 14 and helps to ensure that the maximum amount of force is applied to projectile 4.

Figure 4:
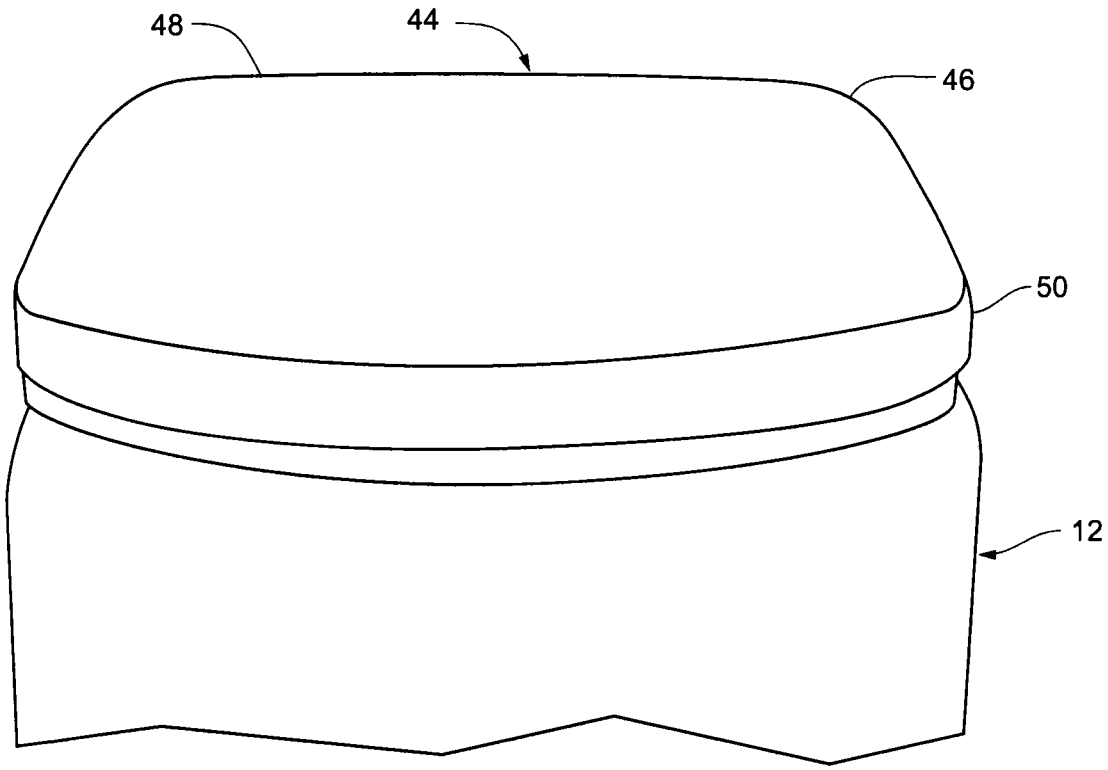
FIG. 4 is a perspective view of a portion of the cartridge assembly including a closure cap according to an embodiment of the invention.
Figure 5:
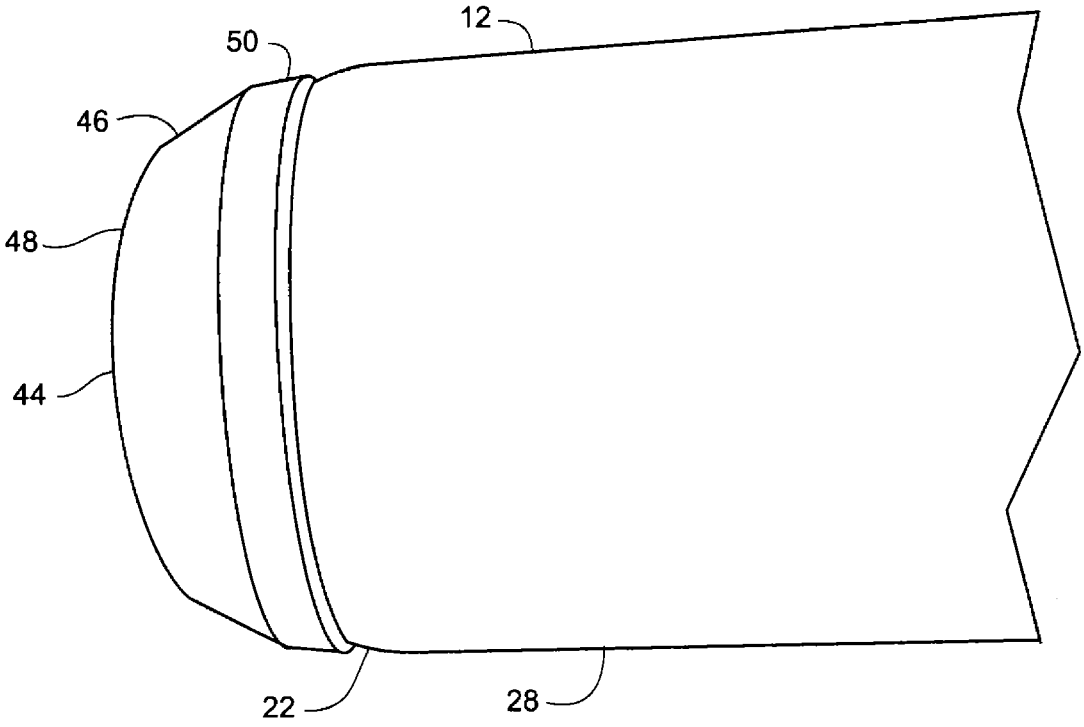
FIG. 5 is a perspective view of a portion of the cartridge assembly including a closure cap according to an embodiment of the invention.
Figure 6:
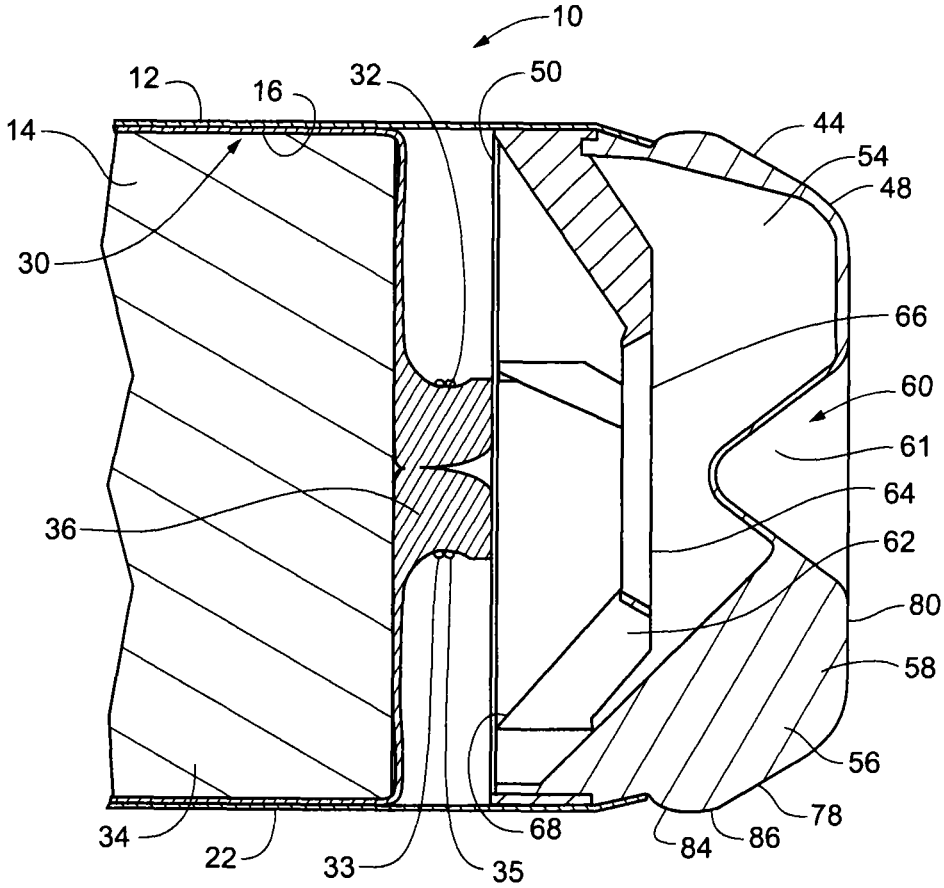
FIG. 6 is a longitudinal sectional view of a portion of the cartridge assembly including a closure cap and a crimped retention bag according to an embodiment of the present invention.

In one embodiment, depicted in FIGS. 4-6, closure plug 44 includes exterior wall 46 having proximate end 48 and distal end 50. Distal end 50 of closure plug 44 is dimensioned to be insertable into proximate end 22 of cartridge case 12. According to an example embodiment, adhesive strip 52 may be disposed at distal end 50 of exterior wall 46 between closure plug 44 and inner surface 26 of cartridge case 12. According to one embodiment, closure plug 44 can be formed to have a solid body.

Figure 8:
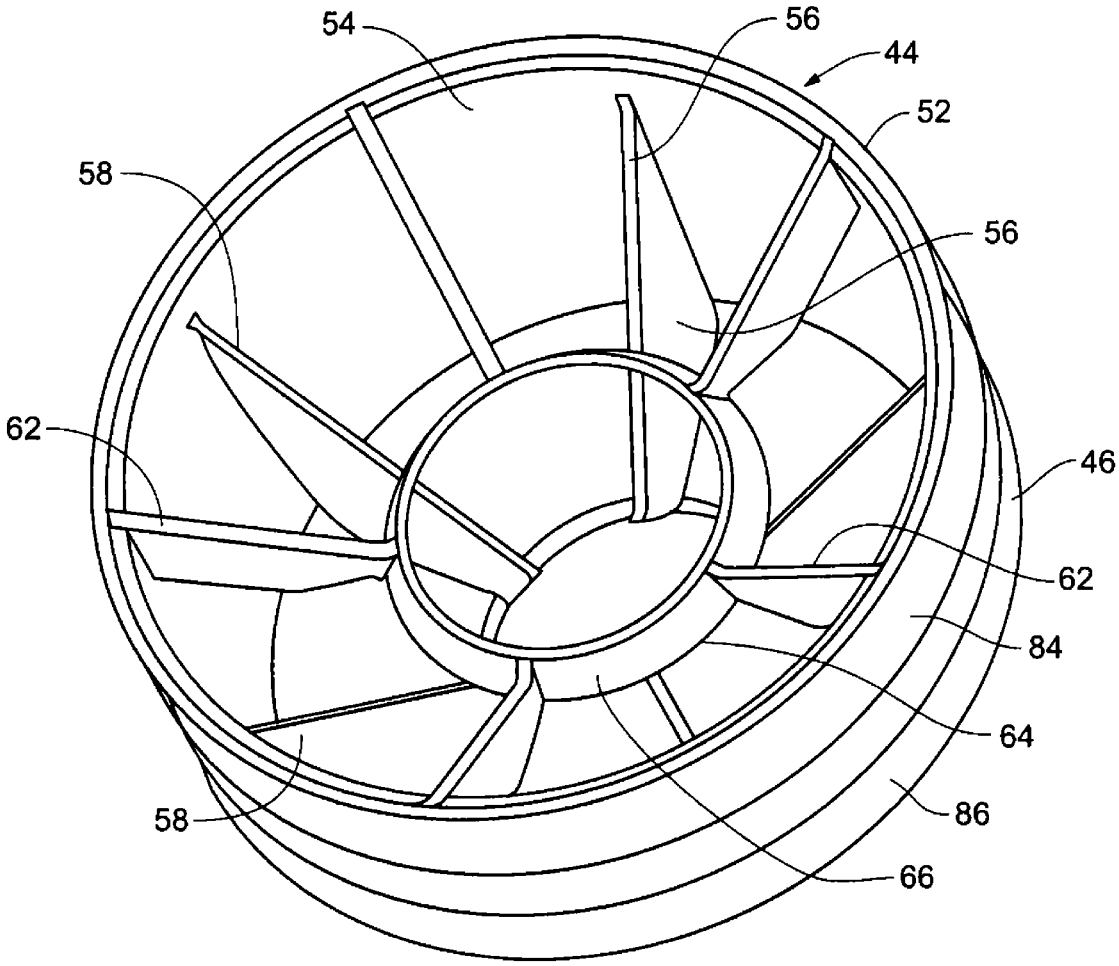
FIG. 8 is a perspective view of a closure cap according to an embodiment of the invention.

According to another embodiment, as depicted in FIGS. 6 and 8 closure plug 44 defines interior space 54 therein and a plurality of ribs 56 within closure plug 44. Ribs 56 include anterior reinforcement ribs 58 within proximal end 48 generally perpendicular to exterior wall 46. Anterior reinforcement ribs 58 may taper from radially to centrally as seen in FIGS. 6 and 8 and may abut proximate conical indent 60 centrally located in closure plug 44. Proximate indent 60 is depicted as conical in shape but may be of any shape and may be formed to complementarily mate to a base of a projectile (not shown) such as a sabot projectile known to those of skill in the art. Proximate indent 60 partially defines projectile space 61.

Closure plug 44 may also present supporting arms 62 and central ring 64. As best seen in FIG. 8, arms 62 extend inwardly from exterior wall 46 and coupled to central ring 64. Arms 62 may extend proximately and centrally from exterior wall 46 to central ring 64. Arms 62 may be radially located approximately half way between anterior reinforcement ribs 58 as depicted in FIG. 8. Arms 62 and anterior reinforcement ribs 58 may number five each as depicted but this should not be considered limiting. Central ring 64 may present angled ring wall 66. Optionally, closure plug 44 may include generally planar distal wall 68.

Figure 7:
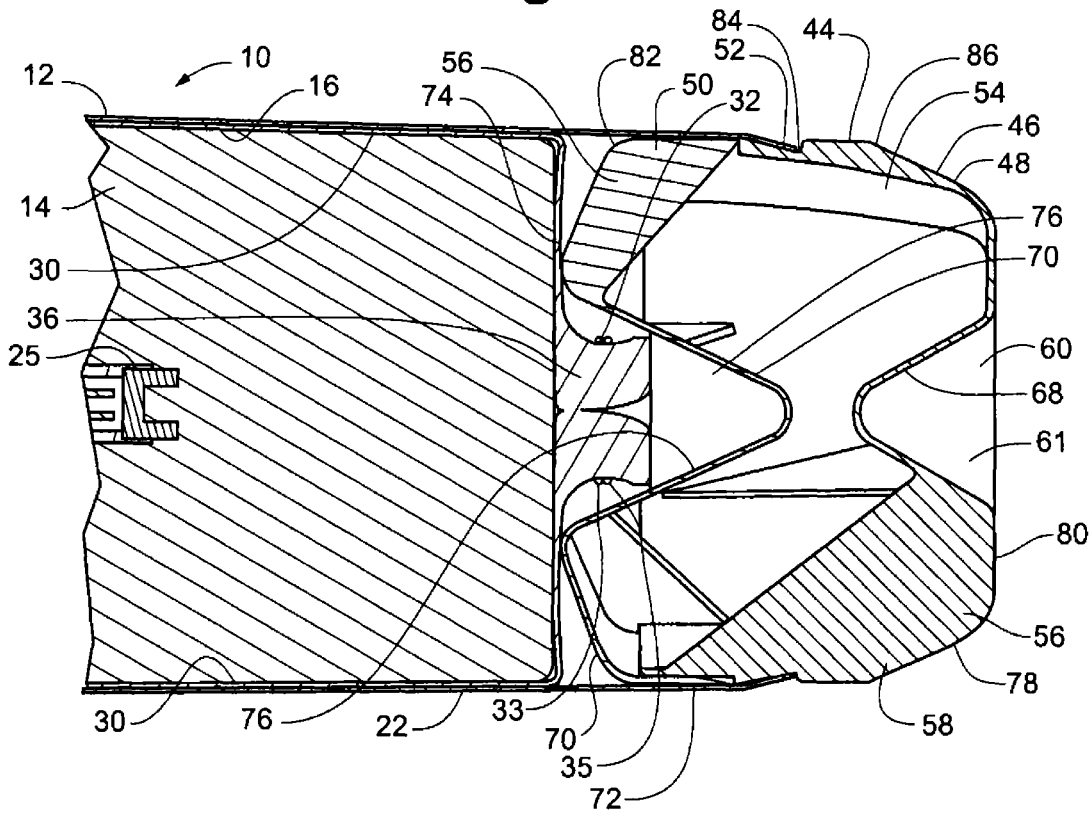
FIG. 7 is a longitudinal sectional view of a portion of the cartridge assembly including a closure cap and a crimped retention bag according to another embodiment of the invention.

Referring to FIG. 7, according to another embodiment of the invention, distal end 52 of closure plug 44 further includes formed wall 70. Formed wall 70 presents peripheral portion 72, intermediate taper 74 and centrally located distal conical indent 76. Peripheral portion 72 mates with exterior wall 46. Exterior wall 46 may present anterior taper 78 and planar nose 80. In this embodiment closure plug 44 present a generally closed structure with internal ribs 56 including anterior reinforcement ribs 58 and posterior reinforcement ribs 82. In this embodiment, closure plug presents annular mating indent 84 and thickened reinforcing ring 86. Anterior reinforcement ribs 58 and posterior reinforcement ribs 82 extend generally radially and may alternate circumferentially as depicted in FIG. 7.

Figure 9:
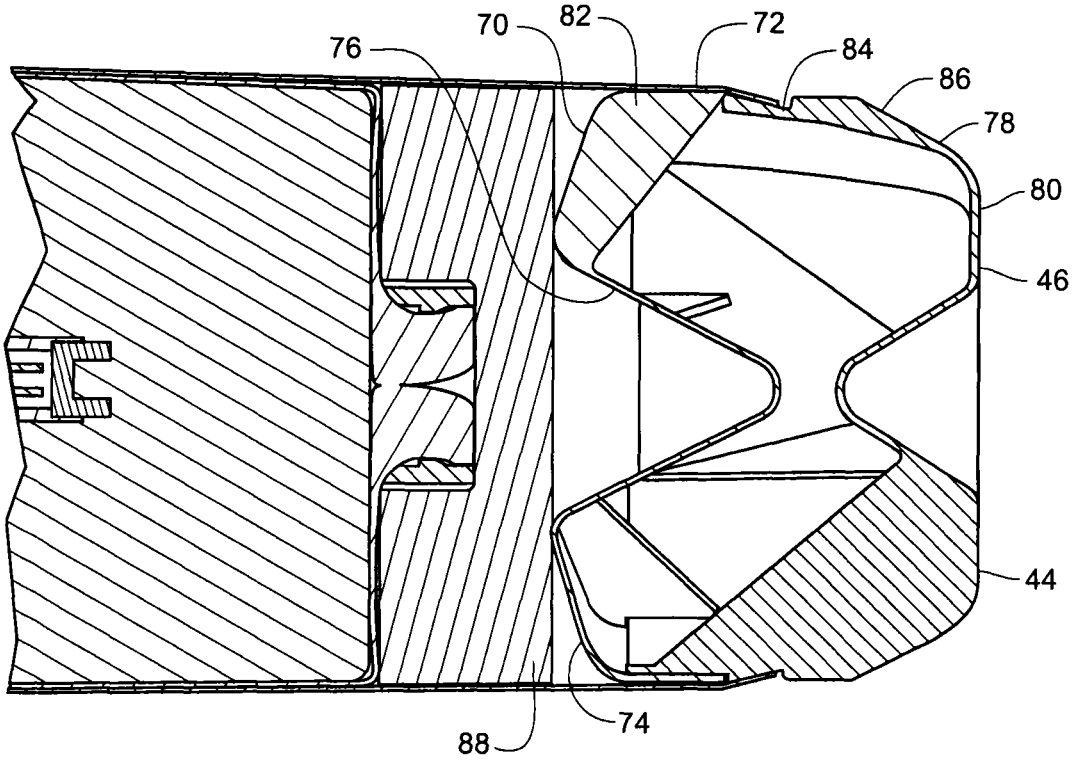
FIG. 9 is a longitudinal sectional view of a portion of the cartridge assembly including a closure cap, wadding and a crimped retention bag according to another embodiment of the invention.

Referring to FIG. 9, the invention may also include foam wadding 88 inserted between closure plug 44 and insulating sleeve 30. For example, 1.5 inch ESD foam wadding maybe inserted behind closure plug 44.

Closure plug 44 may be formed for example, from Torlon 42031L material. In another example embodiment, interior space 54 between exterior wall 46 and distal wall 68 or formed wall 70 may be filled with low density ESD foam.

The invention also includes a method of loading propellant charge 14 into cartridge case 12 including securing open distal end 38 of sleeve 30 to interior surface 26 of cartridge case 12 then extending open proximate end 36 of sleeve 30 outwardly from proximate end 22 of cartridge case 12 followed by inserting at least one portion of propellant charge 14 into cartridge case 12 through the open proximate end 36 of sleeve 30. The method further includes gathering open proximate end 36 of sleeve 30 within proximate end 22 of cartridge case 12 and closing the second open end of sleeve 30 within cartridge case 12 and securing the second open end of sleeve 30 within cartridge case 12 with closure member.

The method may further include securing open proximate end 36 closed with first tie 33. Securing open proximate end 36 closed with first tie 33 may include tying gathered open proximate end 36 closed. The method may also include securing the open proximate end 36 closed with an adhesive such as second adhesive strip 42.

The method may include securing open proximate end 36 of sleeve 30 to interior surface 26 of cartridge case 12 by positioning second adhesive strip 42 between sleeve 30 and interior surface 26 of cartridge case 12.

The method may include inserting closure plug 44 into proximate end 22 of cartridge case 12. The method may also include applying second adhesive strip 42 between closure plug 44 and open proximate end 36 of cartridge case 12.

The method may include selecting the closure plug to present distal conical indent 76 and/or proximate indent 60.

In operation, Referring to FIGS. 2-3 and 6-7, insulating sleeve 30 is affixed to the inner surface 26 of the cartridge case 12 by adhesive strip 40 or another adhesive such that insulating sleeve 30 forms a chute through which propellant charge 14 can be inserted. After a desired amount of propellant charge 14 is inserted through interior channel 34 of insulating sleeve 30 and packed into interior space 20 of cartridge case 12, proximate end 36 of insulating sleeve 30 is gathered and crimped or secured closed with closure member 32. A portion of insulating sleeve 30 and closure member 32 can protrude beyond proximate end 36 of propellant charge 14. According to an embodiment of the invention, second adhesive strip 42 can be used to further secure closed proximate end 36 of insulating sleeve 30 or be used alone to secure sleeve 30 closed. After proximate end 36 of insulating sleeve 30 is closed, cartridge assembly 10 can be rammed into a firing chamber such that proximate end 22 of cartridge case 12 interfaces with a base portion of a projectile (not shown). Insulating sleeve 30 arrests the forward motion of propellant charge 14 at the termination of the ramming of cartridge case 12 to prevent propellant charges 14 from escaping cartridge case 12.

The insulating material of insulating sleeve 30 also insulates the propellant charge 14 from possible high temperatures and hot surfaces in the firing chamber during loading and extraction of a misfired cartridge assembly 10

When closure plug 44 is used, closure plug 44 is inserted into open proximate end 22 of cartridge case 12. Closure plug 44 may be secured by second adhesive strip 42 inserted between closure plug 44 and cartridge case 12. When closure plug 44 as depicted in FIGS. 6 and 8 is used, closure member 32 and open proximate end 36 after having been secured by closure mechanism 32 may fit into projectile space 61 if present. When closure plug 44 as depicted in FIG. 7 is used with cartridge case 12, open proximate end 36 of insulating sleeve 30 may be positioned in projectile space 61 defined by distal conical indent 76.

After a closure plug 44 is inserted into cartridge case 12, proximate end 22 of cartridge case 12 may be crimped into mating indent 84 of closure plug 44.

EXAMPLES

Cartridge assembly 10 including a closure plug 44 as depicted in FIG. 7 was tested utilizing an inert propellant charge 14. Inert propellant charge 14 had a mass of 28.5 kilograms and was positioned with 1.5 inches of clearance between closure plug 44 and propellant charge 14. Insulating sleeve 30 was formed of wool/rayon, bonded to cartridge case 12, interior surface 26 with 3M-1099 adhesive. 1.5 inches of foam wadding 88 was placed between propellant charge 14 and closure plug 44 and cartridge assembly 10 was rammed at 10.0 meters per second. Under these circumstances, movement of closure plug 44 was limited to 0.142 inches. In another test, closure plug 44 moved 0.077 inches after 2 ram tests. Closure plug 44 remained intact and inert propellant charge 14 was retained.

In another test, an inert propellant charge 14 having a mass of 28.5 kilograms was positioned with 0.5 inches clearance between it and closure plug 44 as depicted in FIG. 7. Insulating sleeve 30 was formed of 0.30 inch Kevlar netting and the prepared cartridge assembly 10 was rammed at 10.5 meters per second. Under these circumstances, closure plug 44 moved 0.143 inches after one ram test. Closure plug 44 remained intact and inert propellant charge 14 was retained.

In another test, a 28.5 kilogram inert propellant charge 14 was secured inside insulating sleeve 30 made of 0.30 Kevlar netting and added Kevlar cord was used as first tie 33 to secure insulating sleeve 30. Closure plug 44 as depicted in FIGS. 6 and 8 was utilized permitting a 2.0 inch space between inert propellant charge 14 and closure plug 44. Under these circumstances, impact between inert propellant charge 14 and closure plug 44 was prevented.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative embodiments.

What is claimed:

1. A method of loading a propellant charge into a cartridge case, comprising:
- inserting a closure plug into the open end of the cartridge case;
- securing a first open end of a sleeve including a generally cylindrical flexible envelope to an interior surface of a cartridge case;
- extending a second open end of the sleeve outwardly from an open end of the cartridge case;
- inserting at least one portion of the propellant charge into the cartridge case through the second open end of the sleeve;
- gathering the second open end of the sleeve within the open end of the cartridge case;
- closing the second open end of the sleeve within the cartridge case; and
- securing the second open end of the sleeve closed within the cartridge case with a closure member.

2. The method as claimed in claim 1, wherein securing further comprises securing the second open end closed with a strap or cord.

3. The method as claimed in claim 2, wherein securing the second open end closed with a strap or cord further comprises tying the gathered second open end closed.

4. The method as claimed in claims 1, further comprising securing the second open end closed with an adhesive.

5. The method as claimed in claims 1, wherein securing the first open end of the sleeve to the interior surface of the cartridge case further comprises positioning an adhesive strip between the sleeve and the interior of the cartridge case.

6. The method as claimed in claim 1, further comprising applying an adhesive between the closure plug and the open end of the cartridge case.

7. The method as claimed in claim 1, further comprising selecting the closure plug to present a distal indent.

8. The method as claimed in claims 1, further comprising selecting the closure plug to present a proximal indent.

9. A cartridge for an artillery shell comprising:
- a cartridge case having a generally cylindrical body and a substantially closed first case end and an open second case end, the generally cylindrical body including a substantially cylindrical wall having an interior surface;
- a closure plug securable to the open second case end of the cartridge case;
- an adhesive interposed between the closure plug and the open second case end of the cartridge case;
- a sleeve comprising a generally cylindrical flexible envelope having an open first sleeve end and an open second sleeve end, the first sleeve end being secured to the interior surface of the cylindrical wall of the cartridge case and the second sleeve end being extendible outwardly from the second case end; and
- a securing device that secures closed the second sleeve end whereby a propellant charge placed in the cartridge case through the sleeve is secured within the cartridge case.

10. The cartridge as claimed in claim 9, wherein the closure plug further comprises an exterior wall defining an interior space and a plurality of arms extending inwardly from the exterior wall and each of the arms being coupled to a central ring structure located within the interior space.

11. The cartridge as claimed in claim 9, wherein the closure plug further comprises a wall extending inwardly from the exterior wall and together with the exterior wall substantially enclosing the interior space.

12. The cartridge as claimed in claim 9, wherein the closure plug further comprises an exterior wall at a proximate end thereof presenting a proximal indentation shaped to mate with a projectile.

13. The cartridge as claimed in claim 9, wherein the closure plug further comprises a distal wall at a distal end thereof presenting a distal indentation shaped to receive a portion of the sleeve that has been secured closed.

14. The cartridge as claimed in claim 9, further comprising a foam wadding insertable at the second case end.

* * * * *

UNITED STATES PATENT AND TRADEMARK OFFICE

CERTIFICATE OF CORRECTION

PATENT NO. : 8,627,770 B2
APPLICATION NO. : 13/155014
DATED : January 14, 2014
INVENTOR(S) : Gregg J. Severson It is certified that error appears in the above-identified patent and that said Letters Patent is hereby corrected as shown below:

In the Specification

Column 2, Line 16
Delete the word "in". Insert the word --the-- after the word "within", so the line reads "...improvement within the cartridge...".

Column 4, Line 19
Delete the words "further includes".

Column 5, Line 52
Delete the word "maybe" and insert the words --may be--.

In the Claims

Column 8, Line 4
Delete the word "claims" and insert the word --claim--.

Column 8, Line 6
Delete the word "claims" and insert the word --claim--.

Column 8, Line 15
Delete the word "claims" and insert the word --claim--.

Signed and Sealed this
Twelfth Day of August, 2014

Michelle K. Lee

Michelle K. Lee
*Deputy Director of the United States Patent and Trademark Office*